United States Patent [19]

Frame

[11] 4,121,997

[45] Oct. 24, 1978

[54] TREATING A PETROLEUM DISTILLATE WITH A SUPPORTED METAL PHTHALOCYANINE AND AN ALKALINE REAGENT CONTAINING ALKANOLAMINE HALIDE

[75] Inventor: Robert R. Frame, Glenview, Ill.

[73] Assignee: UOP Inc., Des Plaines, Ill.

[21] Appl. No.: 868,599

[22] Filed: Jan. 11, 1978

[51] Int. Cl.[2] ..... C10G 27/06
[52] U.S. Cl. ..... 208/206
[58] Field of Search ..... 208/206, 207; 252/431 N

[56] References Cited

U.S. PATENT DOCUMENTS

| | | | |
|---|---|---|---|
| 2,560,374 | 7/1951 | Shmidl | 208/206 |
| 2,744,854 | 5/1956 | Urban, Jr. | 208/206 |
| 3,164,544 | 1/1965 | Bowers | 208/207 |
| 3,408,287 | 10/1968 | Urban et al. | 208/207 |
| 4,033,860 | 7/1977 | Carlson | 208/206 |

*Primary Examiner*—George Crasanakis
*Attorney, Agent, or Firm*—James R. Hoatson, Jr.; Robert W. Welch; William H. Page, II

[57] ABSTRACT

A process for treating a mercaptan-containing sour petroleum distillate is disclosed. The process comprises passing said distillate in admixture with an oxidizing agent through a fixed bed of a supported metal phthalocyanine catalyst in the presence of an alkanolamine halide, e.g., ethanoltrimethylammonium chloride, comingled with an alkaline reagent.

13 Claims, No Drawings

TREATING A PETROLEUM DISTILLATE WITH A SUPPORTED METAL PHTHALOCYANINE AND AN ALKALINE REAGENT CONTAINING ALKANOLAMINE HALIDE

Process for treating sour petroleum distillates wherein the distillate is passed in contact with a supported metal phthalocyanine catalyst in the presence of an oxidizing agent and an alkaline reagent, have become well-known and widely practiced in the petroleum refining industry. One such process is described in U.S. Pat. No. 2,988,500. The process as typically designed to effect the oxidation of offensive mercaptans contained in a sour petroleum distillate with the formation of innocuous disulfides—a process commonly referred to as sweetening. The oxidizing agent is most often air admixed with the sour petroleum distillate to be treated, and the alkaline reagent is most often an aqueous caustic solution charged continuously to the process, or intermittently as required. Gasoline, including natural, straight run and cracked gasoline, is the most frequently treated petroleum distillate. Other sour petroleum distillates subject to treatment include the mercaptan-containing normally gaseous petroleum fractions as well as the higher boiling naphtha, kerosene, jet fuel and lube oil fractions, and the like.

It is an object of this invention to present a novel process for treating a sour petroleum distillate and effecting improved oxidation of the mercaptans contained therein.

In one of its broad aspects, the present invention embodies a process which comprises passing a mercaptan-containing sour petroleum distillate in admixture with an oxidizing agent through a fixed bed of a supported metal phthalocyanine catalyst in the presence of an alkanolamine halide comingled with an alkali metal hydroxide, said alkanolamine halide having the structural formula

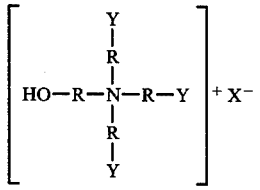

wherein R is an alkylene radical containing up to about 3 carbon atoms, Y is a hydroxyl radical or hydrogen, and X is chloride, fluoride, bromide or iodide.

One of the more specific embodiments concerns a process which comprises passing said sour petroleum distillate in admixture with air through a fixed bed of a charcoal-supported cobalt phthalocyanine catalyst in the presence of an ethanoltrialkylammonium chloride comingled with an aqueous sodium hydroxide solution.

A still more specific embodiment relates to a process for treating a mercaptan-containing sour petroleum distillate which comprises passing said distillate in admixture with air through a fixed bed of charcoal-supported cobalt phthalocyanine monosulfonate catalyst at a liquid hourly space velocity of from about 0.1 to about 10 in the presence of ethanoltrimethylammonium chloride comingled with an aqueous sodium hydroxide solution, said ethanoltrimethylammonium chloride being employed in from about a 0.1:1 to about a 1:1 mole ratio with said sodium hydroxide.

Other objects and embodiments of this invention will become apparent in the following detailed specification.

In the process of sweetening a sour petroleum distillate, it has heretofore been the practice to oxidize the mercaptans contained therein in the presence of an alkaline reagent. The supported metal phthalocyanine catalyst is typically initially saturated with the alkaline reagent, and the alkaline reagent thereafter passed in contact with the catalyst bed, continuously or intermittently as required, admixed with the sour petroleum distillate. Any suitable alkaline reagent may be employed. An alkali metal hydroxide in aqueous solution, e.g., sodium hydroxide in aqueous solution, is most often employed. The solution may further comprise a solubilizer to promote mercaptan solubility, e.g., alcohol, and especially methanol, ethanol, n-propanol, isopropanol, etc., and also phenols, cresols, and the like. A particularly preferred alkaline reagent is a caustic solution comprising from about 2 to about 30 wt. % sodium hydroxide. The solubilizer, when employed, is preferably methanol, and the alkaline solution may suitably comprise from about 2 to about 100 vol. % thereof. While sodium hydroxide and potassium hydroxide constitute the preferred alkaline reagents, others including lithium hydroxide, rubidium hydroxide and cesium hydroxide, are also suitably employed.

Pursuant to the present invention, an alkanolamine halide is comingled with the aforementioned alkaline reagent to provide improved oxidation and conversion of mercaptans to disulfides. The alkanolamine halide, preferably an alkanolamine chloride, is suitably employed in from about a 0.1:1 to about a 1:1 mole ratio with the alkaline metal hydroxide or other alkaline reagent. The alkanolamine halides herein contemplated are represented by the general formula

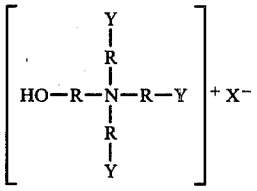

wherein R is an alkylene radical containing up to about 3 carbon atoms, Y is hydroxyl radical or hydrogen, and X is chloride, bromide, fluoride or iodide. Suitable alkanolamine halides thus include alkanoltrialkylammonium halides, particularly ethanoltrialkylammonium halides like ethanoltrimethylammonium chloride, ethanoltriethylammonium chloride and ethanoltripropylammonium chloride, but also methanoltrimethylammonium chloride, methanoltriethylammonium chloride, methanoltripropylammonium chloride, propanoltrimethylammonium chloride, propanoltriethylammonium chloride, propanoltripropylammonium chloride, and the like. Other suitable alkanolamine halides include dimethanoldimethylammonium chloride, dimethanoldiethylammonium chloride, dimethanoldipropylammonium cloride, trimethanolmethylammonium chloride, trimethanolethylammonium chloride, trimethanolpropylammonium chloride, diethanoldimethylammonium chloride, diethanoldiethylammonium chloride, diethanoldipropylammonium chloride, triethanolmethylammonium chloride, triethanolpropylammonium chloride, tetraethanolammonium chloride, and the like.

Ethanoltrimethylammonium chloride (choline chloride) is a preferred alkanolamine halide.

The metal phthalocyanines employed to catalyze the oxidation of mercaptans contained in sour petroleum distillates generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, nickel phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. The metal phthalocyanine is most frequently employed as a derivative thereof, the commercially available sulfonated derivatives, for example, cobalt phthalocyanine monosulfonate, cobalt phthalocyanine disulfonate or a mixture thereof being particularly preferred. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

For use in the fixed bed treating operation, the metal phthalocyanine catalyst can be adsorbed or impregnated on a solid adsorbent support in any conventional or otherwise convenient manner. In general, the support or carrier material in the form of spheres, pills, pellets, granules or other particles of uniform or irregular shape and size, is dipped, soaked, suspended or otherwise immersed in an aqueous or alcoholic solution and/or dispersion of the metal phthalocyanine catalyst, or the aqueous or alcoholic solution and/or dispersion may be sprayed onto, poured over, or otherwise contacted with the adsorbent support. In any case, the aqueous solution and/or dispersion is separated, and the resulting composite is allowed to dry under ambient temperature conditions, or dried at an elevated temperature in an oven or in a flow of hot gases, or in any other suitable manner.

It is generally preferable to adsorb as much metal phthalocyanine on the adsorbent support or carrier material as will form a stable catalytic composite—generally up to about 25 wt. %, although a lesser amount in the range of from about 0.1 to about 10 wt. % affords a suitably active catalytic composite. One suitable and convenient method comprises predisposing the solid support or carrier material in the distillate treating zone or chamber as a fixed bed, and passing the metal phthalocyanine solution and/or dispersion through the bed in order to form the catalytic composite in situ. This method allows the solution and/or dispersion to be recycled one or more times to achieve a desired concentration of the metal phthalocyanine on the adsorbent support. In still another method, the adsorbent support may be predisposed in said treating chamber and the chamber thereafter filled with the metal phthalocyanine solution and/or dispersion to soak the support for a predetermined period, thereby forming the catalytic composite in situ.

The metal phthalocyanine catalyst can be adsorbed or impregnated on any of the well-known solid adsorbent materials generally utilized as a catalyst support. Preferred adsorbent materials include the various charcoals produced by the destructive distillation of wood, peat, lignite, nutshells, bones, and other carbonaceous matter, and preferably such charcoals as have been heat treated or chemically treated or both, to form a highly porous particle structure of increased adsorbent capacity and generally defined as activated carbon or charcoal. Said adsorbent materials also include the naturally occurring clays and silicates, for example, diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc. or combinations thereof like silica-alumina, silica-zirconia, alumina-zirconia, etc. Any particular solid adsorbent material is selected with regard to its ability under conditions of its intended use. For example, in the treatment of a sour petroleum distillate heretofore described, the solid adsorbent carrier material should be insoluble in, and otherwise inert to, the petroleum distillate at the alkaline reaction conditions existing in the treating zone. In the latter case, charcoal, and particularly activated charcoal, is preferred because of its capacity for metal phthalocyanine, and because of its stability under treating conditions.

The process of this invention can be effected in accordance with prior art treating conditions. The process is usually effected at ambient temperature conditions, although higher temperatures up to about 105° C. are suitably employed. Pressures of up to about 1000 psi or more are operable, although atmospheric or substantially atmospheric pressures are entirely suitable. Contact times equivalent to a liquid hourly space velocity of from about 1 to about 10 or more are effective to achieve a desired reduction in the mercaptan content of a sour petroleum distillate, an optimum contact time being dependent on the size of the treating zone, the quantity of catalyst contained therein, and the character of the distillate being treated.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing gas may be employed. The sour petroleum distillate may be passed upwardly or downwardly through the catalyst bed. The sour petroleum distillate may contain sufficient entrained air, but generally added air is admixed with the distillate and charged to the treating zone concurrently therewith. In some cases, it may be of advantage to charge the air separately to the treating zone and countercurrent to the distillate separately charged thereto.

The sour petroleum distillates vary widely in composition depending on the source of the petroleum from which the distillate was derived, the boiling range of the distillate, and possibly the method of processing the petroleum to produce the distillate. The process of the present invention is particularly adapted to the treatment of petroleum distillates boiling in excess of about 135° C., for example, kerosene, jet fuel, fuel oil, naphtha and the like. These higher boiling distillates generally contain the more difficult oxidizable mercaptans, e.g., the highly hindered branched chain and aromatic thiols—especially the higher molecular weight tertiary and polyfunctional mercaptans.

The following examples are presented in illustration of one preferred embodiment of this invention and are not intended as an undue limitation of a generally braod scope of the invention as set out in the appended claims.

EXAMPLE I

The sour petroleum distillate treated in this and subsequent examples is a kerosene fraction boiling in the 352°-454° F. range at 742mm. The kerosene had a specific gravity of 0.8081 and contained 448 ppm. mercaptan sulfur. In this example, the kerosene was charged downflow through 100cc of a charcoal-supported cobalt phthalocyanine monosulfonate catalyst disposed as a fixed bed in a vertical tubular reactor. The catalyst bed consisted of about 1 wt. % cobalt phthalocyanine monosulfonate adsorbed on 10-30 mesh activated charcoal particles. The kerosene was charged at a liquid hourly space velocity of about 0.5 under 45 psig of air—sufficient to provide about twice the stoichiometric amount of oxygen required to oxidize the mercaptans contained in the kerosene. The catalyst bed was initially wetted with about 10cc of an 8% aqueous sodium hydroxide solution, 10cc of said solution being subsequently charged to the catalyst bed at 12 hour intervals admixed with the kerosene charged thereto. The treated kerosene was analyzed periodically for mercaptan sulfur. The results are set out below in Table I under Run No. 1.

EXAMPLE II

In this example, the described mercaptan-containing kerosene fraction was treated substantially as shown in Example I except that sufficient ethanoltrimethylammonium chloride was comingled with the aqueous sodium hydroxide solution to provide a 0.1 molar ethanoltrimethylammonium chloride solution. The treated kerosene was analyzed periodically for mercaptan sulfur. The analytical results are set out in Table I below under Run No. 2.

EXAMPLE III

The described mercaptan-containing kerosene fraction was again treated substantially as shown in the previous examples except that in this case sufficient ethanoltrimethylammonium chloride was comingled with the aqueous sodium hydroxide to provide a 1.1 molar ethanoltrimethylammonium chloride solution. The treated kerosene was again analyzed periodically for mercaptan sulfur, and the results are tabulated below in Table I under Run No. 3.

TABLE I

| On Steam, Hrs. | Mercaptan Sulfur, ppm. | | |
|---|---|---|---|
| | Run No. 1 | Run No. 2 | Run No. 3 |
| 0 | 448 | 448 | 448 |
| 20 | 13 | 8 | 7 |
| 40 | 13 | 8 | 8 |
| 60 | 12 | 8 | 7 |
| 80 | 12 | 8 | 6 |
| 100 | 12 | 8 | 6 |

I claim as my invention:

1. A process for treating a mercaptan-containing sour petroleum distillate which comprises passing said distillate in admixture with an oxidizing agent through a fixed bed of a supported metal phthalocyanine catalyst in the presence of an alkanolamine halide comingled with an alkaline reagent to oxidize the mercaptan present in said distillate, said alkanolamine halide having the structural formula

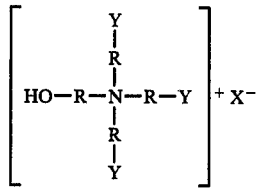

wherein R is an alkylene radical containing up to about 3 carbon atoms, Y is a hydroxyl radical or hydrogen, and X is chloride, bromide, fluoride or iodide.

2. The process of claim 1 further characterized in that said alkanolamine halide is an alkanolamine chloride.

3. The process of claim 1 further characterized in that said alkanolamine halide is an alkanoltrialkylammonium chloride.

4. The process of claim 1 further characterized in that said alkanolamine halide is an ethanoltrialkylammonium chloride.

5. The process of claim 1 further characterized in that said alkanolamine halide is ethanoltrimethylammonium chloride.

6. The process of claim 1 further characterized in that said alkanolamine halide is employed with said alkaline reagent in a mole ratio of from about 0.1:1 to about 1:1.

7. The process of claim 1 further characterized in that said alkaline reagent is an alkali metal hydroxide in from about a 2 wt. % to about a 30 wt. % aqueous solution.

8. The process of claim 1 further characterized in that said alkaline reagent is sodium hydroxide in from about a 2 wt. % to about a 30 wt. % aqueous solution.

9. The process of claim 1 further characterized in that said sour petroleum distillate is passed through said catalyst bed at a liquid hourly space velocity of from about 0.1 to about 10.

10. The process of claim 1 further characterized in that said catalyst is a charcoal-supported cobalt phthalocyanine.

11. The process of claim 1 further characterized in that said catalyst is a charcoal-supported sulfonated derivative of cobalt phthalocyanine.

12. The process of claim 1 further characterized in that said catalyst is a charcoal-supported cobalt phthalocyanine monosulfonate.

13. The process of claim 1 further characterized in that said catalyst comprises from about 0.1 to about 10 wt. % metal phthalocyanine.

* * * * *